US009550952B2

(12) United States Patent
Patel et al.

(10) Patent No.: US 9,550,952 B2
(45) Date of Patent: Jan. 24, 2017

(54) METHOD OF REDUCING AQUEOUS SEPARATION IN AN EMULSION COMPOSITION SUITABLE FOR ENGINE FUELED BY E85 FUEL

(71) Applicant: VANDERBILT CHEMICALS, LLC, Norwalk, CT (US)

(72) Inventors: Mihir K. Patel, Norwalk, CT (US); Ronald J. Hiza, Monroe, CT (US)

(73) Assignee: VANDERBILT CHEMICALS, LLC, Norwalk, CT (US)

( * ) Notice: Subject to any disclaimer, the term of this patent is extended or adjusted under 35 U.S.C. 154(b) by 214 days.

(21) Appl. No.: 14/481,099

(22) Filed: Sep. 9, 2014

(65) Prior Publication Data

US 2015/0075061 A1 Mar. 19, 2015

Related U.S. Application Data

(60) Provisional application No. 61/878,843, filed on Sep. 17, 2013.

(51) Int. Cl.
*C10L 1/32* (2006.01)
*C10M 161/00* (2006.01)

(52) U.S. Cl.
CPC ..... *C10L 1/328* (2013.01); *C10M 161/00* (2013.01); *C10L 2250/08* (2013.01); *C10M 2209/084* (2013.01); *C10M 2217/06* (2013.01); *C10M 2227/066* (2013.01); *C10N 2220/14* (2013.01); *C10N 2220/142* (2013.01); *C10N 2230/24* (2013.01); *C10N 2240/101* (2013.01)

(58) Field of Classification Search
CPC ..... C10N 2040/25; C10N 2040/26; C10N 2040/28; C10N 2220/14; C10N 2220/142; C10N 2230/24; C10N 2240/101; C10N 2240/104; C10N 2240/105; C10N 2040/106
USPC ..... 44/302
See application file for complete search history.

(56) References Cited

U.S. PATENT DOCUMENTS

| | | | | |
|---|---|---|---|---|
| 4,822,508 | A * | 4/1989 | Pennewiss | C08F 220/18 508/264 |
| 4,889,647 | A * | 12/1989 | Rowan | C07F 11/005 508/367 |
| 7,648,950 | B2 * | 1/2010 | Placek | C10M 145/14 508/466 |
| 8,101,559 | B2 * | 1/2012 | Mueller | C08F 220/36 508/469 |
| 8,835,367 | B2 * | 9/2014 | Baum | C10M 145/14 508/464 |
| 2007/0256354 | A1 * | 11/2007 | Gibbs | C10L 1/023 44/451 |
| 2009/0156445 | A1 * | 6/2009 | Lam | C10M 133/04 508/290 |
| 2011/0237474 | A1 | 9/2011 | Mazzamaro et al. | |
| 2011/0263470 | A1 | 10/2011 | Qin et al. | |
| 2012/0108478 | A1 | 5/2012 | Lam | |
| 2012/0135902 | A1 | 5/2012 | Baum et al. | |
| 2014/0194333 | A1 * | 7/2014 | Dance | C10M 145/36 508/580 |
| 2014/0274837 | A1 * | 9/2014 | Eirich | C08G 81/025 508/287 |
| 2015/0175927 | A1 * | 6/2015 | Utaka | C10M 167/00 508/364 |
| 2015/0191672 | A1 * | 7/2015 | Hanyuda | C10M 141/06 508/521 |
| 2015/0203779 | A1 * | 7/2015 | Hanyuda | C10M 169/04 123/1 A |

FOREIGN PATENT DOCUMENTS

WO 2013/182581 A1 12/2013

OTHER PUBLICATIONS

Patel et al., "Effective of Viscosity Index Improvers in Ethanol/Gasoline/Water Emulsions Formed with E25 and E85 in Passenger Car Motor Oils", SAE Int. J. Fuels Lubr. vol. 3, Issue 2, Oct. 2010.

* cited by examiner

*Primary Examiner* — Ellen McAvoy
(74) *Attorney, Agent, or Firm* — Norris McLaughlin & Marcus PA

(57) ABSTRACT

A method for reducing aqueous phase separation of an emulsion comprising ethanol-based fuel and a lubricating oil comprising molybdenum ester amide complex, comprising the step of adding to the lubricating oil a dispersant poly-alkyl (meth) acrylate (DPMA) in an amount from about 0.01 to about 0.5% by weight of the lubricating oil, such that the weight ratio of molybdenum to DPMA is about 2.05 or less.

9 Claims, No Drawings

METHOD OF REDUCING AQUEOUS SEPARATION IN AN EMULSION COMPOSITION SUITABLE FOR ENGINE FUELED BY E85 FUEL

This application claims the benefit of U.S. Provisional Application 61/878,843 filed Sep. 17, 2013.

BACKGROUND OF THE INVENTION

This invention relates to the method of reducing aqueous phase separation and improving emulsion retention capacity of an emulsion composition comprising a lubricant base oil containing molybdenum ester/amide and its combination with alcohol-based fuel, such as E85 fuel and water. E85 is an abbreviation for an ethanol fuel blend of 85% denatured ethanol fuel and 15% gasoline or other hydrocarbon by volume, although the exact ratio of fuel ethanol to hydrocarbon can vary considerably while still carrying the E85 label. The ethanol content is adjusted according to the local climate to maximize engine performance. ASTM D5798 specifies the allowable fuel ethanol content in E85 as ranging from 51% to 83%.

In recent years, use of alternative fuel has resonated with the consumers concerned about U.S. dependence on imported oil as well as the ever increasing price of gasoline. As an alternative fuel to gasoline, use of ethanol produced from biomass has increased in recent years for the internal combustion engine. With the introduction of ethanol in gasoline came the concern of water-phase separation. Water in gasoline can have different effects on an engine, depending on whether it is in solution or forms a separate water phase. While a separate water phase in a fuel can be damaging to an engine, a small amount of water in solution with gasoline should have no adverse effects on engine components.

Although ethanol will readily dissolve water, water will separate from blends of gasoline and ethanol when the solubility limit in ethanol is reached. The amount of water required for this phase separation varies with temperature. When phase separation occurs in an ethanol blended gasoline, the water will actually begin to remove the ethanol from the gasoline. Therefore, the second phase which can occur in ethanol blends contains both ethanol and water. In the case of four stroke engines, the water-ethanol phase may combust in the engine. This combustion can be damaging to the engine because the water ethanol phase creates a leaner combustion mixture. Leaner mixtures tend to combust at highest temperature and can damage engines and also results in reduced fuel economy. In addition, this water-ethanol phase will compete with the blended oil for bonding to the metal engine parts. Therefore, the engine will not have enough lubrication, and engine damage may result. Hence, maintaining emulsion stability of alcohol-gasoline mixed fuel with lubricating oil compositions is a primary concern. Inability to maintain stable emulsions, especially in the cold climate and small infrequent short distance driving cycles, leads to separation of an aqueous layer which results in corrosion of fuel tanks, fuel delivery systems and other critical components of the engine. Hence, any method to reduce aqueous phase separation will be useful.

A particularly useful friction modifier additive used in engine oils is a molybdenum ester amide, available as MOLYAN® 855 from Vanderbilt Chemicals, LLC, of Norwalk, Conn. While this molybdenum compound provides excellent friction modifier properties, it suffers from a drawback when used in engines running alcohol-based fuels, such as E85. In particular, the molybdenum ester amide compound used in such an engine may lead to unwanted aqueous phase separation in the fuel mixture. Accordingly, there is a desire to overcome this problem by formulating a lubricating composition which contains a molybdenum ester amide, but which avoids aqueous phase separation when used with E85 or other alcohol based fuels.

U.S. Pat. Application No. 20120108478 to Lam et al. discloses a lubricant composition suitable for use in engines fueled by gasoline or bio-renewable fuels, or both, comprising an oil of lubricating viscosity and a dispersant system to reduce aqueous separation in an emulsion composition. A dispersant system suitable for use herein can comprise at least one dispersant. Useful dispersants include, but are not limited to, basic nitrogen-containing ashless dispersants, such as hydrocarbyl succinimides; hydrocarbyl succinamides; mixed ester/amides of hydrocarbyl-substituted succinic acids, Mannich condensation products of hydrocarbyl-substituted phenols, formaldehyde and polyamines; and amine dispersants formed by reacting high molecular weight aliphatic or alicyclic halides with amines, such as polyalkylene polyamines. Mixtures of such dispersants can also be used.

Research paper published to Patel et al. (SAE Int. J. Fuels Lubr. 3(2):938-945, 2010) discusses the effect of viscosity index modifier on ethanol/gasoline/water emulsions formed in E25 and E85 fuels in passenger car motor oil. This study includes viscosity index modifiers such as olefin co-polymer (OCP), styrene-isoprene polymer (SI) and poly (alkyl methacrylate) polymer (PMA) at treat rate of 8.9 wt. %, 7.2 wt. % and 5.8 wt. % respectively. This study reported that none of the emulsion exhibited a separate water phase, regardless of the types of viscosity index modifier.

WO 2013/182581 relates to an engine oil additive for increasing fuel economy. The additive comprises a molybdenum compound, such as molybdenum ester amide (MOLYVAN® 855) in an amount which provides 1-1000 ppm (0.0001-0.1 wt. % Mo); a polyalkyl (meth) acrylate at 1-15 wt. %, preferably 2-8 wt. %; a phosphorus compound; and an antioxidant system. It is noted that the invention is specifically directed towards new fuel economy requirements for gasoline and/or diesel engines. There is no mention of E85 ethanol-based fuels, or their attendant emulsion problems.

SUMMARY OF THE INVENTION

In accordance with the present invention, there is disclosed a lubricating composition for use in an alcohol-based fuel engine, comprising an oil of lubricating viscosity and a friction modifier system comprising a molybdenum ester/amide and a dispersant polymethacrylate (PMA) viscosity index modifier.

In the present invention, a composition and method is described to reduce aqueous phase separation capacity and improve emulsion stabilization capacity of an emulsion composition. The emulsion stability problem which is inherent when using a molybdenum ester amide in a lubricating composition in an engine running an alcohol based fuel is surprisingly overcome by using a very low amount of dispersant polymethacrylate (PMA) viscosity index modifier. In contrast to the prior art usage of dispersant PMA (DPMA) as a viscosity index modifier at amounts greater than 1 wt. %, it has been found that amounts as low as 0.01-0.5 wt. %, and even as low as 0.1-0.05 wt. % DPMA, can resolve the issue and avoid aqueous phase separation caused by use of molybdenum ester amide in amounts required to achieve effective friction modifier capabilities, for example at about 0.01-2% (providing 8-1600 ppm molybdenum, or 0.0008-0.16 wt. % Mo). In particular, it is has been found that low amounts of DPMA (less than 0.5 wt. %) may successfully avoid aqueous separation in engines running an E85 fuel in the presence of a molybdenum ester amide friction modifier, where the ratio of DPMA:Mo is about 2.05 or lower.

DETAILED DESCRIPTION OF THE INVENTION

The present invention relates to a composition and method for reducing aqueous phase separation of an emulsion composition comprising alcohol based fuel, water and an oil of lubricating viscosity, said lubricating oil comprising a molybdenum ester/amide, wherein said composition and method comprises adding to the lubricating oil an amount of DPMA viscosity index modifier that is effective to reduce aqueous phase separation.

As used herein, the terms "alcohol based fuel" or "ethanol based fuel" refers to any fuel composition containing from about 10 to about 100 percent by weight of ethanol.

Molybdenum Ester/Amides—Sulfur & Phosphorus-Free Organomolybdenum.

An organomolybdenum compound is prepared by reacting about 1 mole of fatty oil, about 0.1 to 2.5 moles of diethanolamine and a molybdenum source sufficient to yield about 0.1 to 12.0 percent of molybdenum based on the weight of the complex at elevated temperatures (i.e. greater than room temperature, such as a temperature range of about 70° C. to 160° C. The organomolybdenum component of the invention is prepared by sequentially reacting fatty oil, diethanolamine and a molybdenum source by condensation method described in U.S. Pat. No. 4,889,647, incorporated herein by reference, and commercially available from Vanderbilt Chemicals, LLC. of Norwalk, Conn. as MOLYVAN® 855. This compound as used in the present invention contains approximately 8% Mo. The reaction yields a reaction product mixture. The major components are believed to have the structure formulae:

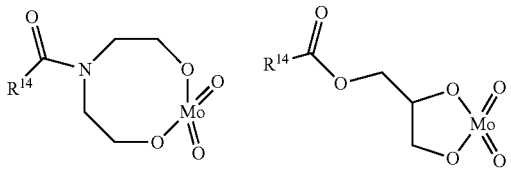

wherein R14 represent a fatty oil residue. An embodiment for the present invention are fatty oils which are glyceryl esters of higher fatty acids containing at least 12 carbon atoms and may contain 22 carbon atoms and higher. Such esters are commonly known as vegetable and animal oils. Examples of useful vegetable oils are those derived from coconut, corn, cottonseed, linseed, peanut, soybean and sunflower seed. Similarly, animal fatty oils such as tallow may be used. The source of molybdenum may be oxygen-containing molybdenum compound capable of reacting with the intermediate reaction products of fatty oil and diethanolamine to form an ester type molybdenum complex. The source of molybdenum includes, among others, ammonium molybdates, molybdenum oxides and mixtures thereof.

Other sulfur and phosphorus free organomolybdenum compounds that may be used in the present invention may be prepared by reacting a sulfur and phosphorus free molybdenum source with an organic compound containing amino and/or alcohol groups. Examples of sulfur and phosphorus free molybdenum sources include molybdenum trioxide, ammonium molybdates, sodium molybdates and potassium molybdate. The amino groups may be monoamines, diamines, or polyamines. The alcohol groups may be monosubstituted alcohols, diols or bis-alcohols or polyalcohols. As an example, the reaction of diamines with fatty oils produces a product containing both amino and alcohol group that can react with the sulfur and phosphorus free molybdenum source.

Examples of sulfur- and phosphorus-free organo molybdenum compounds appearing in patents and patent applications include compounds described in U.S. Pat. Nos. 4,259,195; 4,261,843; 4,164,473; 4,266,945; 4,889,647; 5,137,647; 4,692,256; 5,412,130; 6,509,303; and 6,528,463.

Examples of commercially available sulfur and phosphorus free oil soluble molybdenum compounds are available under the trade name SAKURA-LUBE® from Asahi Denka Kogyo K.K. and MOLYVAN® from Vanderbilt Chemicals, LLC.

In addition to molybdenum esters/amides, the lubricating oil may contain other additives including oxidation inhibitors, detergents, dispersants, viscosity index modifiers, rust inhibitors, anti-wear additives such as molybdenum dithiocarbamates (including Molvyan® 822 from Vanderbilt Chemicals, LLC), and pour point depressants.

Oxidation Inhibitor Components

Oxidation inhibitors that may be used include alkylated diphenylamines (ADPAs) and hindered phenolics.

Alkylated diphenylamines are widely available antioxidants for lubricants. One possible embodiment of an alkylated diphenylamine for the invention are secondary alkylated diphenylamines such as those described in U.S. Pat. No. 5,840,672, which is hereby incorporated by reference. These secondary alkylated diphenylamines are described by the formula X—NH—Y, wherein X and Y each independently represent a substituted or unsubstituted phenyl group wherein the substituents for the phenyl group include alkyl groups having 1 to 20 carbon atoms, preferably 4-12 carbon atoms, alkylaryl groups, hydroxyl, carboxy and nitro groups and wherein at least one of the phenyl groups is substituted with an alkyl group of 1 to 20 carbon atoms, preferably 4-12 carbon atoms. It is also possible to use commercially available ADPAs including VANLUBE® SL (mixed alkylated diphenylamines), DND, NA (mixed alkylated diphenylamines), 81 (p,p'-dioctyldiphenylamine) and 961 (mixed octylated and butylated diphenylamines) manufactured by Vanderbilt Chemicals, LLC, Naugalube® 640, 680 and 438L manufactured by Chemtura Corporation, Irganox® L-57 and L-67 manufactured by BASF Corporation, and Lubrizol 5150A & C manufactured by Lubrizol Corporation. Another possible ADPA for use in the invention is a reaction product of N-phenyl-benzenamine and 2,4,4-trimethylpentene.

Hindered phenolics are also widely available antioxidants for lubricants. A preferred hindered phenol is available from Vanderbilt Chemicals, LLC as Vanlube® BHC (Iso-octyl-3-(3,5-di-tert-butyl-4-hydroxyphenyl) propionate). Other hindered phenols may include orthoalkylated phenolic compounds such as 2,6-di-tert-butylphenol, 4-methyl-2,6-di-tert-butylphenol, 2,4,6-tri-tert-butylphenol, 2-tert-butylphenol, 2,6-disopropylphenol, 2-methyl-6-tert-butylphenol, 2,4-dimethyl-6-tert-butylphenol, 4-(N,N-dimethylaminomethyl)-2,6-di-tert-butylphenol, 4-ethyl-2,6-di-tert-butylphenol, 2-methyl-6-styrylphenol, 2,6-distyryl-4-nonylphenol, 4,4'methylyenebis(2,6-di-tert-butylphenol) and their analogs and homologs. Mixtures of two or more such phenolic compounds are also suitable.

Additional sulfur containing antioxidant such as, methylene bis (dibutyldithiocarbamate) and tolutriazole derivative may be used in the lubricating additive compositions. One such supplemental antioxidant component is commercially available under the trade name VANLUBE® 996E, manufactured by Vanderbilt Chemicals, LLC.

Viscosity Modifiers

Viscosity modifiers (VM) may be used in the lubricant to impart high and low temperature operability. VM may be used to impart that sole function or may be multifunctional. Multifunctional viscosity modifiers also provide additional functionality for dispersant function. Examples of Viscosity modifiers and dispersant viscosity modifiers are polymethacrylates, polyacrylates, polyolefins, styrene-maleic ester copolymer and similar polymeric substances including homopolymers, copolymers and graft copolymers.

The dispersant polymethacrylate (DPMA) viscosity index modifier used in the present invention as an emulsion stabilizer can be described as follows, and as set forth in WO 2013/182581, the disclosure of which is incorporated herein. In addition to the preferred DPMA compound Viscoplex® 6-850 VII, other compounds within this definition would include Viscolex® viscosity index improvers 6-054, 6-565, 6-950 and 6-954, all available from Evonik RohMax Additives GmbH of Darmstadt, Germany:

polyalkyl(meth)acrylate(s) comprising monomer units of:

(a) 0 to 40% by weight of one or more ethylenically unsaturated ester compounds of the formula (I)

(I)

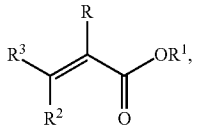

wherein

R is hydrogen or methyl, $R^1$ is a saturated or unsaturated linear or branched alkyl radical having 1 to 5 carbon atoms or a saturated or unsaturated cycloalkyl group having 3 to 5 carbon atoms, $R^2$ and $R^3$ are each independently hydrogen or a group of the formula —COOR' wherein R' is hydrogen or a saturated or unsaturated linear or branched alkyl group having 1 to 5 carbon atoms;

(b) 10 to 98% by weight, preferably 20 to 95% by weight, of one or more ethylenically unsaturated ester compounds of the formula (II)

(II)

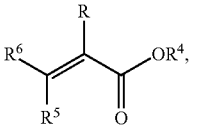

wherein

R is hydrogen or methyl, $R^4$ is a saturated or unsaturated linear or branched alkyl radical having 6 to 15 carbon atoms or a saturated or unsaturated cycloalkyl group having 6 to 15 carbon atoms, $R^5$ and $R^6$ are each independently hydrogen or a group of the formula —COOR" in which R" is hydrogen or a saturated or unsaturated linear or branched alkyl group having 6 to 15 carbon atoms;

(c) 0 to 30% by weight, preferably 5 to 20% by weight, of one or more ethylenically unsaturated ester compounds of the formula (III)

(III)

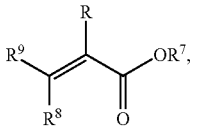

wherein

R is hydrogen or methyl, $R^7$ is a saturated or unsaturated linear or branched alkyl radical having 16 to $40_1$ preferably 16 to 30, carbon atoms or a cycloalkyl group having 16 to 40, preferably 16 to 30, carbon atoms, $R^8$ and $R^9$ are each independently hydrogen or a group of the formula —COOR'" in which R'" is hydrogen or a saturated or unsaturated linear or branched alkyl group having 16 to 40, preferably 16 to 30, carbon atoms;

(d) 0 to 30% by weight of vinyl monomers;

(e) 2 to 10% by weight of at least one N-dispersant monomer.

The DPMA used in the present invention is an emulsion stabilizer at significantly lower treat rate than when the compound is normally used as viscosity index modifier. It is believed to contain about 3.4 wt. % methyl methacrylate monomer, about 0.9 wt. % N-vinyl pyrolidone as the nitrogen-containing monomer, and the balance longer chain alkyl methacrylate monomers, in particular, lauryl methacrylate, MW 214,000. Commercially available dispersant DPMA Viscoplex® 6-850, product of Evonik Rohmax USA Inc. was used.

Base Oil Component

A suitable base blend is any partially formulated engine oil consisting of one or more base oils, dispersants, detergent, antiwear, VI improver, antioxidants and any other additives such that when combined with the inventive composition constitutes a fully formulated motor oil for any gasoline, diesel, natural gas, bio-fuel powered vehicle. Base oils suitable for use in formulating the compositions, additives and concentrates described herein may be selected from any of the synthetic or natural oils or mixtures thereof. The synthetic base oils includes alkyl esters of dicarboxylic acids, polyglycols and alcohols, poly-alpha olefins, including polybutenes, alkyl benzenes, organic esters of phosphoric acids, polysilicone oils and alkylene oxide polymers, interpolymers, copolymers and derivatives thereof where the terminal hydroxyl group have been modified by esterification, etherification and the like.

Natural base oil include animal oils and vegetable oils (e.g. castor oil, lard oil) liquid petroleum oils and hydrorefined, solvent treated or acid treated mineral lubricating oils of paraffinic, naphthenic and mixed paraffinic naphthenic types. Oils of lubricating viscosity derived from coal or shale are also useful base oils. The base oils typically have viscosity of about 2.5 to about 15 cSt and preferably about 2.5 to about 11 cSt at 100° C.

Detergent Components

The lubricating composition may also include detergents. Detergents as used herein are preferably metal salts of organic acids. The organic portion of the detergent is preferably sulfonate, carboxylate, phenates, and salicylates. The metal portion of the detergent is preferably an alkali or alkaline earth metal. Preferred metals are sodium, calcium, potassium and magnesium. Preferably the detergents are overbased, meaning that there is a stoichiometric excess of metal over that needed to form neutral metal salts.

Dispersant Components

The lubricating composition may also include dispersants. Dispersants may include, but are not limited to, a soluble polymeric hydrocarbon backbone having functional groups capable of associating with particles to be dispersed. Typically, amide, amine, alcohol or ester moieties attached to the polymeric backbone via bridging groups. Dispersants may be selected from ashless succinimide dispersants, amine dispersants, Mannich dispersants, Koch dispersants and polyalkylene succinimide dispersants.

Antiwear Components

Zinc dialkyl dithiophosphates (ZDDPs) may also be used in the lubricating oil additive compositions. ZDDPs have good antiwear and antioxidant properties and have been used as wear protection for the critical components of engines. Many patents address the manufacture and use of ZDDPs including U.S. Pat. Nos. 4,904,401; 4,957,649, and 6,114,288. Non limiting general ZDDP types are primary and secondary ZDDPs, and mixtures of primary and secondary ZDDPs. Additional supplemental antiwear components may be used in the lubricating oil additive composition. This includes, but not limited to, borate esters, ashless dithiocarbamates and metal dithiocarbamates.

Other Components

Rust inhibitors selected from the group consisting of metal sulfonate based such as calcium dinonyl naphthalene sulfonate, DMTD based rust inhibitors such as 2,5-Dimercapto-1,3,4-Thiadiazole Alkyl Polycarboxylate may be used.

Pour point depressants are particularly important to improve low temperature qualities of a lubricating oil. Pour point depressants contained in the additive composition may be selected from polymethacrylates, vinyl acetate or maleate copolymer, styrene maleate copolymer.

EXAMPLES

The following examples are illustrative of this invention and its beneficial properties. In these examples, as well as throughout this application, all parts and percentages are by weight of the total lubricating composition, unless otherwise indicated. Lubricating compositions according to the present disclosure were formulated as shown in Tables 1-4. Each example was subjected to the E85 Emulsion Screener Test, in which a mixture of 10% E85 fuel, 10% water and 80% test oil is blended by Waring® blender or equivalent for 1 minute at room temperature and the resulting emulsion is placed in a graduated cylinder and kept at ambient temperature at between 0° C. to −10° C. for 24 hours. The desired result [PASS] of the emulsion test is to have no aqueous separation (0%) and at least 85% emulsion remaining.

Example 1

In Table 1, the "base blend" is prepared by combining mineral oil, over based detergent, dispersant, pour point depressant, metal dialkyldithiophosphate and mixtures of hindered phenolics and alkylated diphenylamines. The base blend is then further formulated as described in Examples 1A through 1D. Example 1A is a control and contains no friction modifier. Example 1B is prepared by blending molybdenum dithiocarbamate with example 1A. Example 1C is prepared by blending molybdenum ester/amide (MOLYVAN® 855) to example 1A. Example 1D is prepared by blending a combination of molybdenum dithiocarbamate and molybdenum ester/amide to example 1A. In example 1C, the total amount of molybdenum from the molybdenum ester/amide is 160 ppm. In Example 1D, the total amount of molybdenum from the molybdenum ester/amide is 80 ppm. As can be seen from the results mentioned in Table 1, Examples 1A and 1B performed acceptably and maintain emulsion stability with no separation of aqueous phase, while examples 1C and 1D failed to maintain stable emulsion and resulted in separation of an aqueous phase. These results indicate that the presence of molybdenum ester/amide adversely affects the emulsion stability of E85 fuel, water and lubricating composition, resulting in aqueous phase separation (while also demonstrating that it is the structure of the molybdenum ester amide itself, rather than molybdenum per se as represented by molybdenum dithiocarbamate as in Example 1B). In the previously mentioned study reported by Patel et al., it was indicated that the use of VI modifier in the high amounts tested results in an avoidance of aqueous phase separation, regardless of the type of viscosity index modifier. However, the present data indicates that this is not true for a lubricating formulation that contains molybdenum ester/amide in the presence of olefin copolymer, one of the VI modifiers discussed by Patel. As seen in Table 2, the presence of the VI modifier olefin copolymer alone, even at a high rate of 7 wt. %, cannot prevent the molybdenum ester amide from causing aqueous phase separation. In contrast, it is surprisingly seen that the dispersant PMA VI modifier, Viscoplex® 6-850, does prevent aqueous phase separation in the presence of molybdenum ester amide. What is even more unexpected, however, is that this effect can be achieved at significantly lower rates of the Viscoplex dispersant PMA than is suggested by Patel.

TABLE 1

| | Examples | Components (wt. %) 1A | 1B | 1C | 1D |
|---|---|---|---|---|---|
| 1 | Base Blend* | 87.38 | 87.38 | 87.38 | 87.38 |
| 2 | VI modifier - Olefin Coplymer | 7 | 7 | 7 | 7 |
| 3 | Friction Modifier - Molybdenum Ester/Amide | — | — | 0.2 | 0.1 |
| 4 | Friction Modifier - Molybdenum Dithiocarbamate | — | 0.31 | — | 0.155 |
| 5 | Diluent Oil** | 5.62 | 5.31 | 5.42 | 5.365 |
| 6 | Total | 100 | 100 | 100 | 100 |
| 7 | 0° C. to −10° C. Oil Separation (%) | 0 | 0 | 88 | 87 |
| 8 | 0° C. to −10° C. Aqueous Separation (%) | 0 | 0 | 12 | 13 |
| 9 | 0° C. to −10° C. Emulsion (%) | 100 | 100 | 0 | 0 |
| 10 | Ambient (° C.) Oil Separation (%) | 10 | 10 | 88 | 86 |
| 12 | Ambient (° C.) Aqueous Separation (%) | 0 | 0 | 12 | 14 |
| 13 | Ambient (° C.) Emulsion (%) | 90 | 90 | 0 | 0 |

*Base blend is mineral oil including over based detergent, dispersant and pour point depressant, Metal dialkyldithiophosphate and Mixture of Hindered Phenol and Alkylated Diphenylamine

**Diluent is mineral oil without additives to bring the total to 100%

TABLE 2

| | Examples | Components (wt. %) 2A | 2B |
|---|---|---|---|
| 1 | Base Blend* | 88.48 | 88.48 |
| 2 | VI Modifier - Olefin Coplomer | 7 | — |
| 3 | VI Modifier - Viscoplex 6-850 Dispersant polymethacrylate | — | 7 |
| 4 | Friction Modifier - Molybdenum Ester/Amide | 0.2 | 0.2 |
| 5 | Friction Modifier - Molybdenum Dithiocarbamate | 0.163 | 0.163 |
| 6 | Diluent Oil** | 4.257 | 5.02 |
| 7 | Total | 100 | 100 |
| 8 | 0° C. to −10° C. Oil Separation (%) | 91 | 0 |
| 9 | 0° C. to −10° C. Aqueous Separations (%) | 9 | 0 |
| 10 | 0° C. to −10° C. Emulsion (%) | 0 | 100 |
| 11 | Ambient (° C.) Oil Separation (%) | 94 | 0 |
| 12 | Ambient (° C.) Aqueous Separation (%) | 6 | 0 |
| 13 | Ambient (° C.) Emulsion (%) | 0 | 100 |

*Base blend is mineral oil including over based detergent, dispersant and pour point depressant, Metal dialkyldithiophosphate, Mixture of Hindered Phenol and Alkylated Diphenylamine, Calcium Dinonyl Naphthalene Sulfonate, Organo borate ester, 2,5-Dimercapto-1,3,4-Thiadiazole Alkyl Polycarboxylate, Methylene Bis (dibutyledithiocarbamate) and tolutriazole derivative

**Diluent is mineral oil without additives to bring the total to 100%

TABLE 3

| Examples | 3A | 3B | 3C | 3D | 3E |
|---|---|---|---|---|---|
| 1 Base Blend* | 94.78 | 94.78 | 94.78 | 94.78 | 94.78 |
| 2 Aristonate S-4000 Low Molecular Wt. Alkyl Aryl Sulfonate | — | 0.2 | — | — | — |
| 3 Aristonate C-5000 Neutral Calcium Sulfonate | — | — | 0.2 | — | — |
| 4 Calcium alkylaryl sulfonate | — | — | — | 0.2 | — |
| 5 VI Modifier-Viscoplex 6-850 Dispersant polymethacrylate | — | — | — | — | 0.2 |
| 6 Diluent Oil** | 5.22 | 5.02 | 5.02 | 5.02 | 5.42 |
| 7 Total | 100 | 100 | 100 | 100 | 100 |
| 8 0° C. to −10° C. Oil Separation (%) | 89 | 89 | 89 | 88 | 30 |
| 9 0° C. to −10° C. Aqueous Separation (%) | 11 | 11 | 11 | 12 | 0 |
| 10 0° C. to −10° C. Emulsion (%) | 0 | 0 | 0 | 0 | 70 |
| 11 Ambient (° C.) Oil Separation (%) | 89 | 90 | 89 | 89 | 0 |
| 12 Ambient (° C.) Aqueous Separation (%) | 11 | 10 | 11 | 11 | 0 |
| 13 Ambient (° C.) Emulsion (%) | 0 | 0 | 0 | 0 | 100 |

*Base blend is mineral oil including over based detergent, dispersant and pour point depressant, Olefin Copolymer, Metal dialkyldithiophosphate, Mixture of Hindered Phenol and Alkylated Diphenylamine, Molybdenum Ester/Amide, Calcium Dinonyl Naphthalene Sulfonate
**Diluent is mineral oil without additives to bring the total to 100%

As can be seen from the lubrication composition mentioned in Table 3, Example 3A is the lubrication composition prepared by blending mineral oil, detergent, dispersant, pour point depressant, olefin copolymer as VI modifier, metal dialkyldithiophosphate, mixture of hindered phenol and alkylated diphenylamine, molybdenum ester/amide and calcium dinonyl naphthalene sulfonate. Results indicated that lubricant composition shown in example 3A failed to maintain emulsion and separate aqueous phase. Various different methods were tested to stabilize the E85 fuel, water and lubricating oil emulsion which includes the use of different emulsifiers such as low molecular weight alkyl aryl sulfonate, neutral calcium sulfonate, and calcium alkylaryl sulfonate at 0.2 wt. % treat rate as shown in Table 3 as Example 3B, 3C and 3D respectively. Examples 3B, 3C and 3D failed to maintain emulsion stability. Surprisingly, we have discovered that use of dispersant PMA at 0.2 wt. % treat rate (Example 3E) helps to maintain emulsion stability as well as protects against aqueous phase separation. Dispersant PMA is typically used at 4.0-7.0 wt. % treat rate as a viscosity index modifier. However, the present invention demonstrates the use of low levels of dispersant PMA as an emulsifier for a lubrication composition in the presence of E85 fuel and water.

TABLE 4

| Examples | Component (wt. %) | | | | | |
|---|---|---|---|---|---|---|
| | 4A | 4B | 4C | 4D | 4E | 4F |
| 1 Base Blend* | 88.48 | 88.48 | 88.48 | 88.48 | 88.48 | 88.48 |
| 2 VI Improver-Olefin Copolymer | 7.00 | 7.00 | 7.00 | 7.00 | 7.00 | 7.00 |
| 3 Molybdenum Ester/Amide, | 0.2 | 0.2 | 0.2 | 0.2 | 0.2 | 0.2 |
| 4 VI Improver-Viscoplex 6-850 Dispersant polymethacrylate | — | 0.05 | 0.025 | 0.01 | — | — |
| 5 Viscoplex 3-200 Non-dispersant polymethacrylate | — | — | — | — | 0.05 | — |
| 6 Viscoplex 1-333 Non-dispersant polymethacrylate | — | — | — | — | — | 0.05 |
| 7 Diluent Oil** | 4.42 | 4.37 | 4.395 | 4.41 | 4.37 | 4.37 |
| 8 Total | 100 | 100 | 100 | 100 | 100 | 100 |
| 9 0° C. to −10° C. Oil Separation (%) | 88 | 20 | 30 | 30 | 86 | 86 |
| 10 0° C. to −10° C. Aqueous Separations (%) | 12 | 0 | 0 | 0 | 14 | 14 |
| 11 0° C. to −10° C. Emulsion (%) | 0 | 80 | 70 | 70 | 0 | 0 |
| 12 Ambient (° C.) Oil Separation (%) | 87 | 65 | 74 | 70 | 85 | 85 |
| 13 Ambient (° C.) Aqueous Separation (%) | 13 | 0 | 0 | 0 | 15 | 15 |
| 14 Ambient (° C.) Emulsion (%) | 0 | 35 | 26 | 30 | 0 | 0 |

*Base blend is mineral oil including over based detergent, dispersant and pour point depressant, Metal dialkyldithiophosphate, Mixture of Hindered Phenol and Alkylated Diphenylamine, Molybdenum Ester/Amide, Calcium Dinonyl Naphthalene Sulfonate, Organo borate ester, 2,5-Dimercapto-1,3,4-Thiadiazole Alkyl Polycarboxylate, Methylene Bis (dibutyledithiocarbamate) and tolutriazole derivative
**Diluent is mineral oil without additives to bring the total to 100%

Table 4 further exemplifies the use of dispersant PMA as a unique method to reduce aqueous phase separation in an emulsion composition comprising E85 fuel, water and lubricating oil. Example 4A is a complicated lubrication composition that includes base blend, olefin copolymer as VI improver, metal dialkyldithiophosphate, mixture of hindered phenol and alkylated diphenylamine as antioxidant, molybdenum ester/amide as friction modifiers, calcium dinonyl naphthalene sulfonate as rust inhibitors, 2,5-Dimercapto-1,3,4-Thiadiazole Alkyl Polycarboxylate as metal deactivator, organo borate ester as supplemental antiwear and methylene Bis(dibutyledithiocarbamate) and tolutriazole derivative as supplemental antioxidant. Example 4A failed to reduce aqueous phase separation in an emulsion with E85 fuel and water. Examples 4B, 4C and 4D are prepared by blending dispersant PMA at 0.05 wt. %, 0.025 wt. % and 0.01 wt. % to example 4A, respectively. Example 4B, 4C and 4D demonstrate the use of dispersant PMA as a method that can effectively reduce aqueous phase separation at significantly lower treat rates. In contrast, non-dispersant PMA, as in examples 4E and 4F, was blended to example 4A at 0.05 wt. % and was ineffective in preventing aqueous separation. This further highlights that it is dispersant PMA in particular, as opposed to other PMA (such as non-dispersant), olefin copolymer, or other known emulsion stabilizers, which is particularly effective in dealing with emulsion instability caused by molybdenum ester amide.

TABLE 5

| | Examples | Component (wt. %) | | | | |
|---|---|---|---|---|---|---|
| | | 5A | 5B | 5C | 5D | 5E |
| 1 | Base Blend* | 87.38 | 87.38 | 87.38 | 87.38 | 87.38 |
| 2 | VII-Olefin Copolymer | 7 | 7 | 7 | 7 | 7 |
| 3 | Molybdenum Ester/Amide | 0.2 | 0.2 | 0.2 | 0.2 | 0.2 |
| 4 | VII-Viscoplex 6-850 Dispersant PMA | 0.01 | 0.025 | 0.05 | 0.2 | 0.5 |
| 5 | Diluent Oil** | 5.41 | 5.395 | 5.37 | 5.22 | 4.92 |
| 6 | Total | 100 | 100 | 100 | 100 | 100 |
| 7 | 0° C. to −10° C. Emulsion Separation (%) | 75 | 78 | 80 | 60 | 86 |
| 8 | 0° C. to −10° C. Aqueous Separation (%) | 0 | 0 | 0 | 0 | 0 |
| 9 | 0° C. to −10° C. Oil Separation (%) | 25 | 22 | 20 | 40 | 14 |
| 10 | Ambient(° C.) Emulsion Separation (%) | 75 | 80 | 82 | 0 | 98 |
| 11 | Ambient(° C.) Aqueous Separation (%) | 0 | 0 | 0 | 0 | 0 |
| 12 | Ambient (° C.) Oil Separation (%) | 25 | 20 | 18 | 100 | 02 |

*Base blend is mineral oil including over based detergent, dispersant and pour point depressant, Metal dialkyldithiophosphate, Mixture of Hindered Phenol and Alkylated Diphenylamine,
**Diluent is mineral oil without additives to bring the total to 100%

TABLE 6

| | Examples | Components (wt. %) | | | | |
|---|---|---|---|---|---|---|
| | | 6A | 6B | 6C | 6D | 6E |
| 1 | Base Blend* | 87.38 | 87.38 | 87.38 | 87.38 | 87.38 |
| 2 | VII-Olefin Copolymer | 7 | 7 | 7 | 7 | 7 |
| 3 | Molybdenum Ester/Amide | 0.4 | 0.4 | 0.4 | 0.4 | 0.4 |
| 4 | VII-Viscoplex 6-850 Dispersant PMA | 0.01 | 0.025 | 0.05 | 0.2 | 0.5 |
| 5 | Diluent Oil** | 5.21 | 5.195 | 5.17 | 5.02 | 4.72 |
| 6 | Total | 100 | 100 | 100 | 100 | 100 |
| 7 | 0° C. to −10° C. Emulsion Separation (%) | 0 | 22 | 57 | 62 | 87 |
| 8 | 0° C. to −10° C. Aqueous Separation (%) | 13 | 0 | 0 | 0 | 0 |

TABLE 6-continued

| | Examples | Components (wt. %) | | | | |
|---|---|---|---|---|---|---|
| | | 6A | 6B | 6C | 6D | 6E |
| 9 | 0° C. to −10° C. Oil Separation (%) | 87 | 78 | 43 | 38 | 13 |
| 10 | Ambient (° C.) Emulsion Separation (%) | 0 | 100 | 100 | 100 | 100 |

TABLE 6-continued

| | Examples | Components (wt. %) | | | | |
|---|---|---|---|---|---|---|
| | | 6A | 6B | 6C | 6D | 6E |
| 11 | Ambient (° C.) Aqueous Separation (%) | 13 | 0 | 0 | 0 | 0 |
| 12 | Ambient (° C.) Oil Separation (%) | 87 | 0 | 0 | 0 | 0 |

*Base blend is mineral oil including over based detergent, dispersant and pour point depressant, Metal dialkyldithiophosphate, Mixture of Hindered Phenol and Alkylated Diphenylamine,
**Diluent is mineral oil without additives to bring the total to 100%

TABLE 7

| | Examples | Components (wt. %) | | | | | |
|---|---|---|---|---|---|---|---|
| | | 7A | 7B | 7C | 7D | 7E | 7F |
| 1 | Base Blend* | 87.38 | 87.38 | 87.38 | 87.38 | 87.38 | 87.38 |
| 2 | VII-Olefin Copolymer | 7 | 7 | 7 | 7 | 7 | 7 |
| 3 | Molybdenum Ester/Amide | 0.641 | 0.641 | 0.641 | 0.641 | 0.641 | 0.641 |
| 4 | VII-Viscoplex 6- 850 Dispersant PMA | 0.01 | 0.025 | 0.03 | 0.05 | 0.2 | 0.5 |
| 5 | Diluent Oil** | 4.969 | 4.954 | 4.949 | 4.929 | 4.779 | 4.479 |
| 6 | Total | 100 | 100 | 100 | 100 | 100 | 100 |
| 7 | 0° C. to −10° C. Emulsion Separation (%) | 0 | 25 | 25 | 10 | 75 | 76 |

TABLE 7-continued

| Examples | Components (wt. %) | | | | | |
|---|---|---|---|---|---|---|
| | 7A | 7B | 7C | 7D | 7E | 7F |
| 8 0° C. to −10° C. Aqueous Separation (%) | 11 | 0 | 0 | 0 | 0 | 0 |
| 9 0° C. to −10° C. Oil Separation (%) | 89 | 75 | 75 | 90 | 25 | 24 |
| 10 Ambient (° C. ) Emulsion Separation (%) | 0 | 23 | 23 | 10 | 100 | 100 |
| 11 Ambient (° C. ) Aqueous Separation (%) | 11 | 0 | 0 | 0 | 0 | 0 |
| 12 Ambient (° C. ) Oil Separation (%) | 89 | 77 | 77 | 90 | 0 | 0 |

*Base blend is mineral oil including over based detergent, dispersant and pour point depressant, Metal dialkyldithiophosphate, Mixture of Hindered Phenol and Alkylated Diphenylamine,
**Diluent is mineral oil without additives to bring the total to 100%

TABLE 8

| Examples | Components (wt. %) | | | | |
|---|---|---|---|---|---|
| | 8A | 8B | 8C | 8D | 8E |
| 1 Base Blend* | 87.38 | 87.38 | 87.38 | 87.38 | 87.38 |
| 2 VII-Olefin Copolymer | 7 | 7 | 7 | 7 | 7 |
| 3 Molybdenum Ester/Amide | 1.28 | 1.28 | 1.28 | 1.28 | 1.28 |
| 4 VII-Viscoplex 6-850 Dispersant PMA | 0.01 | 0.025 | 0.05 | 0.2 | 0.5 |
| 5 Diluent Oil** | 4.328 | 4.315 | 4.29 | 4.14 | 3.84 |
| 6 Total | 100 | 100 | 100 | 100 | 100 |
| 7 0° C. to −10° C. Emulsion Separation (%) | 0 | 0 | 10 | 76 | 86 |
| 8 0° C. to −10° C. Aqueous Separation (%) | 13 | 13 | 0 | 0 | 0 |
| 9 0° C. to −10° C. Oil Separation (%) | 87 | 87 | 90 | 24 | 14 |
| 10 Ambient(° C.) Emulsion Separation (%) | 0 | 0 | 10 | 98 | 100 |
| 11 Ambient(° C.) Aqueous Separation (%) | 13 | 13 | 0 | 0 | 0 |
| 12 Ambient (° C.) Oil Separation (%) | 87 | 87 | 90 | 02 | 0 |

*Base blend is mineral oil including over based detergent, dispersant and pour point depressant, Metal dialkyldithiophosphate, Mixture of Hindered Phenol and Alkylated Diphenylamine,
**Diluent is mineral oil without additives to bring the total to 100%

Tables 5-8 extend the use of dispersant PMA as a method to reduce aqueous phase separation in an emulsion composition comprising E85, water and lubricating oil at higher molybdenum content. The examples demonstrate that the use of dispersant PMA can effectively reduce aqueous phase separation at significantly lower treat rate. In reviewing the data as a whole in Table 9, it is seen that there is a clear effectiveness of the dispersant PMA to prevent aqueous separation, regardless of the amount of Mo present from the molybdenum ester amide, so long as the ratio of Mo:DPMA is less than or equal to about 2.05, for amounts DPMA up to about 0.5% of the lubricating composition.

TABLE 9

| | MOLYVAN ® 855 (wt. %) | Mo (wt. %) | DPMA (wt. %) | Mo/DPMA | 0° C. to −10° C. Aqueous Separations (%) |
|---|---|---|---|---|---|
| 5A | 0.2 | 0.016 | 0.01 | 1.6 | Pass |
| 5B | 0.2 | 0.016 | 0.025 | 0.64 | Pass |
| 5C | 0.2 | 0.016 | 0.05 | 0.32 | Pass |
| 5D | 0.2 | 0.016 | 0.2 | 0.08 | Pass |
| 5E | 0.2 | 0.016 | 0.5 | 0.032 | Pass |
| 6A | 0.4 | 0.032 | 0.01 | 3.2 | Fail |
| 6B | 0.4 | 0.032 | 0.025 | 1.28 | Pass |
| 6C | 0.4 | 0.032 | 0.05 | 0.64 | Pass |
| 6D | 0.4 | 0.032 | 0.2 | 0.16 | Pass |
| 6E | 0.4 | 0.032 | 0.5 | 0.064 | Pass |
| 7A | 0.641 | 0.0512 | 0.01 | 5.12 | Fail |
| 7B | 0.641 | 0.0512 | 0.025 | 2.048 | Pass |
| 7C | 0.641 | 0.0512 | 0.03 | 1.71 | Pass |

TABLE 9-continued

| | MOLYVAN ® 855 (wt. %) | Mo (wt. %) | DPMA (wt. %) | Mo/DPMA | 0° C. to −10° C. Aqueous Separations (%) |
|---|---|---|---|---|---|
| 7D | 0.641 | 0.0512 | 0.05 | 1.024 | Pass |
| 7E | 0.641 | 0.0512 | 0.2 | 0.256 | Pass |
| 7F | 0.641 | 0.0512 | 0.5 | 0.1024 | Pass |
| 8A | 1.28 | 0.1024 | 0.01 | 10.24 | Fail |
| 8B | 1.28 | 0.1024 | 0.025 | 4.096 | Fail |
| 8C | 1.28 | 0.1024 | 0.05 | 2.048 | Pass |
| 8D | 1.28 | 0.1024 | 0.2 | 0.512 | Pass |
| 8E | 1.28 | 0.1024 | 0.5 | 0.2048 | Pass |

Table 10 shows that even among different types of dispersant PMA, the particular claimed DPMA such as Evonik® Viscoplex® 6-850 is surprisingly superior to other dispersant PMA. While Afton® HiTEC® 5710, which is outside the DPMA definition as set forth in the present disclosure, is effective in preventing aqueous separation at very low amounts of Mo (0.016 wt. %), once higher amounts of Mo are provided, even increasing the amount of the Afton dispersant PMA will not cure the emulsion stability issue.

TABLE 10

| Examples | Components (wt. %) | | | | | | |
|---|---|---|---|---|---|---|---|
| | 10A | 10B | 10C | 10D | 10E | 10F | 10G |
| 1 Base Blend* | 87.38 | 85 | 85 | 85 | 85 | 85 | 85 |
| 2 Olefin Copolymer | 7 | 7 | 7 | 7 | 7 | 7 | 7 |
| 3 Molybdenum Ester/Amide | 0.2 | 0.2 | 0.2 | 0.4 | 0.641 | 1.28 | 0.641 |
| 4 VII-Dispersant PMA (Afton Hitech 5710) | 0.01 | 0.025 | 0.05 | 0.01 | 0.01 | 0.01 | 0.025 |
| 5 Diluent Oil** | 5.41 | 5.395 | 5.37 | 5.21 | 4.969 | 4.33 | 4.954 |
| 6 Total | 100 | 100 | 100 | 100 | 100 | 100 | 100 |
| 7 0° C. to −10° C. Emulsion Separation (%) | 100 | 100 | 100 | 0 | 0 | 0 | 0 |
| 8 0° C. to −10° C. Oil Separation (%) | 0 | 0 | 0 | 85 | 87 | 86 | 87 |
| 9 0° C. to −10° C. Aqueous Separation (%) | 0 | 0 | 0 | 15 | 13 | 14 | 13 |
| 10 Ambient (° C.) Emulsion Separation (%) | 23 | 22 | 25 | 0 | 0 | 0 | 0 |
| 11 Ambient (° C.) Oil Separation (%) | 77 | 78 | 75 | 87 | 86 | 85 | 87 |
| 12 Ambient (° C.) Aqueous Separation (%) | 0 | 0 | 0 | 13 | 14 | 15 | 13 |

| Examples | Components (wt. %) | | | | | | |
|---|---|---|---|---|---|---|---|
| | 10H | 10I | 10J | 10K | 10L | 10M | 10N |
| 1 Base Blend* | 85 | 85 | 85 | 85 | 85 | 85 | 85 |
| 2 Olefin Copolymer | 7 | 7 | 7 | 7 | 7 | 7 | 7 |
| 3 Molybdenum Ester/Amide | 1.28 | 0.641 | 1.28 | 0.641 | 1.28 | 0.641 | 1.28 |
| 4 VII-Dispersant PMA (Afton Hitech 5710) | 0.025 | 0.05 | 0.05 | 0.1 | 0.1 | 0.2 | 0.2 |
| 5 Diluent Oil** | 4.315 | 4.929 | 4.29 | 4.879 | 4.24 | 4.779 | 4.14 |
| 6 Total | 100 | 100 | 100 | 100 | 100 | 100 | 100 |
| 7 0° C. to −10° C. Emulsion Separation (%) | 0 | 0 | 0 | 0 | 0 | 0 | 0 |
| 8 0° C. to −10° C. Oil Separation (%) | 86 | 85 | 87 | 85 | 84 | 85 | 87 |
| 9 0° C. to −10° C. Aqueous Separation (%) | 14 | 15 | 13 | 15 | 16 | 15 | 13 |
| 10 Ambient (° C.) Emulsion Separation (%) | 0 | 0 | 0 | 0 | 0 | 0 | 0 |
| 11 Ambient (° C.) Oil Separation (%) | 86 | 85 | 87 | 86 | 87 | 80 | 87 |
| 12 Ambient (° C.) Aqueous Separation (%) | 14 | 15 | 13 | 14 | 13 | 20 | 13 |

*Base blend is mineral oil including over based detergent, dispersant and pour point depressant, Metal dialkyldithiophosphate, Mixture of Hindered Phenol and Alkylated Diphenylamine,

**Diluent is mineral oil without additives to bring the total to 100%

What is claimed is:

1. A method for reducing aqueous phase separation of an emulsion comprising alcohol-based fuel, and a lubricating oil comprising molybdenum ester amide complex, comprising the step of adding to the lubricating oil a dispersant polyalkyl (meth) acrylate (DPMA) in an amount from about 0.01 to about 0.5% by weight of the lubricating oil, such that the weight ratio of molybdenum present from the molybdenum ester amide complex to DPMA (Mo: DPMA) is about 2.05 or less.

2. The method of claim 1, wherein aqueous phase separation at ambient temperature and at 0° C. to −10° C. for 24 hours is 0%.

3. The method of claim 1, wherein the molybdenum ester amide complex is prepared by reacting about 1 mole of fatty oil, about 0.1 to 2.5 moles of diethanolamine and a molybdenum source sufficient to yield about 0.1 to 12.0 percent of molybdenum based on the weight of the complex.

4. The method of claim 3, wherein the DPMA comprises (a) 0 to 40% by weight of one or more ethylenically unsaturated ester compounds of the formula (I)

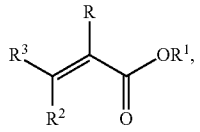

(I)

wherein

R is hydrogen or methyl, $R^1$ is a saturated or unsaturated linear or branched alkyl radical having 1 to 5 carbon atoms or a saturated or unsaturated cycloalkyl group having 3 to 5 carbon atoms, $R^2$ and $R^3$ are each independently hydrogen or a group of the formula —COOR' wherein R' is hydrogen or a saturated or unsaturated linear or branched alkyl group having 1 to 5 carbon atoms;

(b) 10 to 98% by weight, of one or more ethylenically unsaturated ester compounds of the formula (II)

(II)

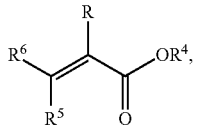

wherein

R is hydrogen or methyl, $R^4$ is a saturated or unsaturated linear or branched alkyl radical having 6 to 15 carbon atoms or a saturated or unsaturated cycloalkyl group having 6 to 15 carbon atoms, $R^5$ and $R^6$ are each independently hydrogen or a group of the formula —COOR" in which R" is hydrogen or a saturated or unsaturated linear or branched alkyl group having 6 to 15 carbon atoms;

(c) 0 to 30% by weight of one or more ethylenically unsaturated ester compounds of the formula (III)

(III)

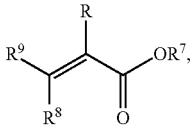

wherein

R is hydrogen or methyl, $R^7$ is a saturated or unsaturated linear or branched alkyl radical having 16 to 40, carbon atoms or a cycloalkyl group having 16 to 40 carbon atoms, $R^8$ and $R^9$ are each independently hydrogen or a group of the formula —COOR'" in which R'" is hydrogen or a saturated or unsaturated linear or branched alkyl group having 16 to 40 carbon atoms;

(d) 0 to 30% by weight of vinyl monomers;

(e) 2 to 10% by weight of at least one N-dispersant monomer.

5. The method of claim 1, wherein the alcohol-based fuel is E85 fuel.

6. The method of claim 1, wherein the amount of molybdenum provided from the complex is between about 0.016% and about 0.1024% by weight of the lubricating oil.

7. The method of claim 6, wherein the DPMA is present at less than or equal to about 0.2% by weight of the lubricating oil.

8. The method of claim 7, wherein the DPMA is present at less than or equal to about 0.05% by weight of the lubricating oil.

9. A method for reducing aqueous phase separation of an emulsion comprising alcohol-based fuel, and a lubricating oil comprising molybdenum ester amide complex, comprising the step of adding to the lubricating oil a dispersant polyalkyl (meth) acrylate (DPMA) in an amount from about 0.01 to about 0.5% by weight of the lubricating oil, such that the weight ratio of molybdenum present from the molybdenum ester amide complex to DPMA (Mo: DPMA) is about 2.05 or less, wherein:

the DPMA comprises (a) 2.0 to 40% by weight of one or more ethylenically unsaturated ester compounds of the formula (I)

(I)

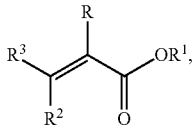

wherein

R is hydrogen or methyl, $R^1$ is a saturated or unsaturated linear or branched alkyl radical having 1 to 5 carbon atoms or a saturated or unsaturated cycloalkyl group having 3 to 5 carbon atoms, $R^2$ and $R^3$ are each independently hydrogen or a group of the formula —COOR' wherein R' is hydrogen or a saturated or unsaturated linear or branched alkyl group having 1 to 5 carbon atoms;

(b) 10 to 98% by weight, of one or more ethylenically unsaturated ester compounds of the formula (II)

(II)

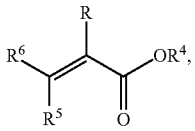

wherein

R is hydrogen or methyl, $R^4$ is a saturated or unsaturated linear or branched alkyl radical having 6 to 15 carbon atoms or a saturated or unsaturated cycloalkyl group having 6 to 15 carbon atoms, $R^5$ and $R^6$ are each independently hydrogen or a group of the formula —COOR" in which R" is hydrogen or a saturated or unsaturated linear or branched alkyl group having 6 to 15 carbon atoms;

(c) 0 to 30% by weight of one or more ethylenically unsaturated ester compounds of the formula (III)

(III)

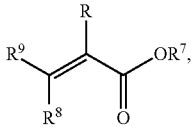

wherein

R is hydrogen or methyl, $R^7$ is a saturated or unsaturated linear or branched alkyl radical having 16 to 40 carbon atoms or a cycloalkyl group having 16 to 40 carbon atoms, $R^8$ and $R^9$ are each independently hydrogen or a group of the formula —COOR'" in which R'" is hydrogen or a saturated or unsaturated linear or branched alkyl group having 16 to 40 carbon atoms;

(d) 0 to 30% by weight of vinyl monomers;

(e) 2 to 10% by weight of at least one N-dispersant monomer;

the molybdenum ester amide complex is prepared by reacting about 1 mole of fatty oil, about 0.1 to 2.5 moles of diethanolamine and a molybdenum source sufficient to yield about 0.1 to 12.0 percent of molybdenum based on the weight of the complex; and the amount of molybdenum provided from the complex is between about 0.016% and about 0.1024% by weight of the lubricating oil.

* * * * *